United States Patent [19]

Talonen

[11] Patent Number: 4,568,065

[45] Date of Patent: Feb. 4, 1986

[54] MEANS FOR SEPARATING SOLID AND MOLTEN PARTICLES FROM THE EXHAUST GASES OF METALLURGICAL FURNACES AND WAY TO RECOVER LEAD FROM SUCH GASES

[75] Inventor: Timo T. Talonen, Nakkila, Finland

[73] Assignee: Outokumpu Oy, Helsinki, Finland

[21] Appl. No.: 461,459

[22] Filed: Jan. 27, 1983

[30] Foreign Application Priority Data

Feb. 12, 1982 [FI] Finland ..... 820483

[51] Int. Cl.[4] ..... F27B 15/12; F27B 11/00

[52] U.S. Cl. ..... 266/157; 266/182; 373/166

[58] Field of Search ..... 266/157, 148–154, 266/144, 182; 75/25, 26, 92; 373/166

[56] References Cited

U.S. PATENT DOCUMENTS

| | | | |
|---|---|---|---|
| 2,894,831 | 7/1959 | Old et al. | 75/9 |
| 3,554,515 | 1/1971 | Tonooka | 266/157 |
| 3,915,692 | 10/1975 | Herbert et al. | 75/92 |
| 3,997,333 | 12/1976 | Fey | 75/26 |
| 4,179,284 | 12/1979 | Weigel | 75/92 |

FOREIGN PATENT DOCUMENTS

| | | | |
|---|---|---|---|
| 726130 | 1/1966 | Canada | 75/77 |

*Primary Examiner*—Melvyn J. Andrews
*Attorney, Agent, or Firm*—Brooks Haidt Haffner & Delahunty

[57] ABSTRACT

The invention concerns a means for separating molten particles from the exhaust gases of metallurgical furnaces and for returning them to the furnace space (3). As taught by the invention, a molten dust cyclone has been provided substantially within the furnace space (3) or in its immediate vicinity, this cyclone comprising a vertical cylindrical chamber (4), a passage (8) leading from the furnace space (3) tangentially to chamber (4), an exit aperture (5) in the upper part of the chamber for removing the gas and a tap aperture (6) in the lower part of the chamber for returning to the furnace space (3) the solid and molten material that has separated from the gas.

The invention furthermore concerns a way recover lead from the exhaust gases of a metallurgical furnace by regulating the oxygen partial pressure in the exhaust gases to be in the range of about $10^{-16}$ to $10^{-10}$ atmospheres at temperature 1250°–1450° K. and by subjecting the exhaust gases immediately to centrifugal separation to the purpose of separating lead fog droplets from the gas to the purpose of returning the molten lead to the furnace.

5 Claims, 5 Drawing Figures

Figure 3:
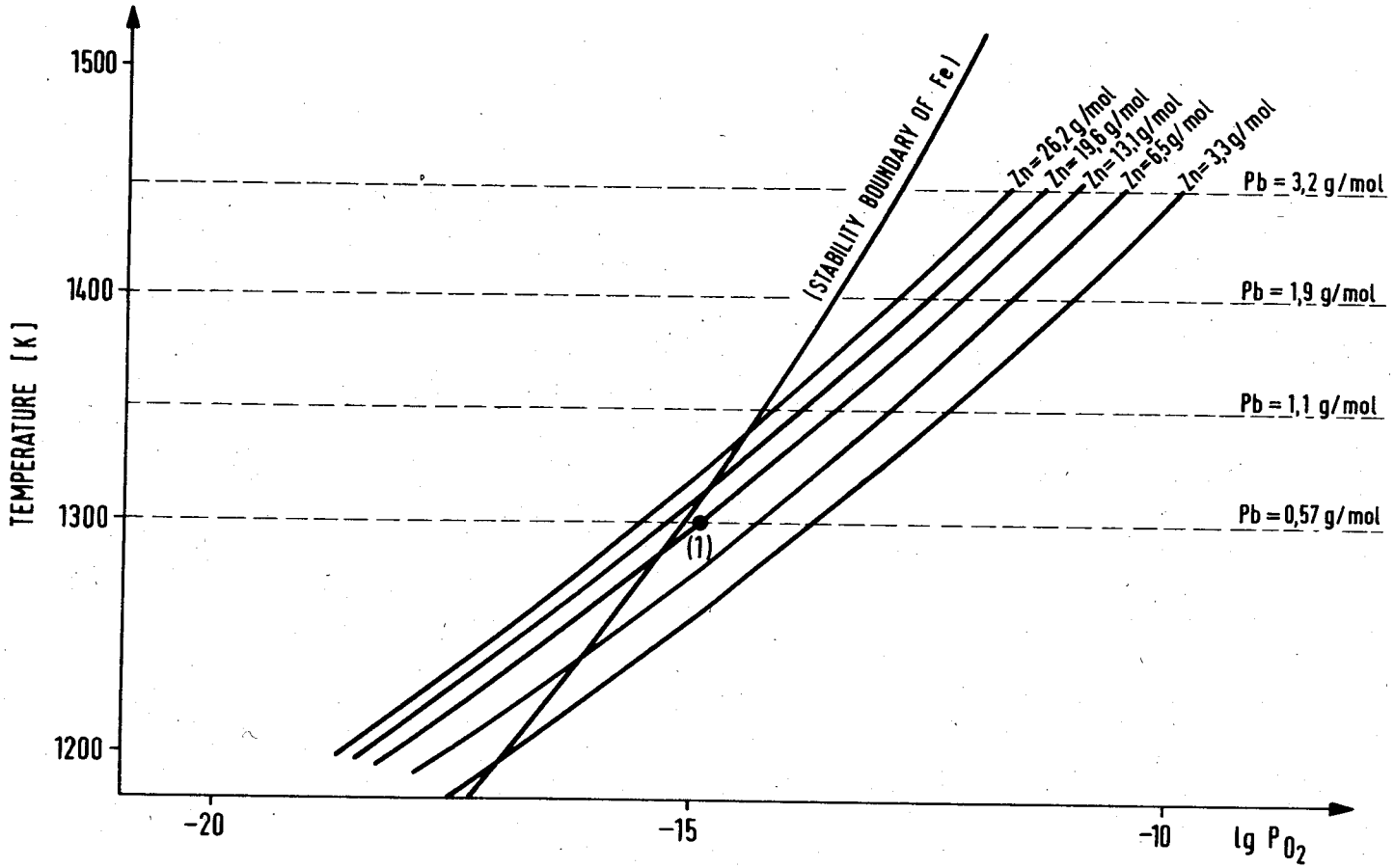

Fig. 1
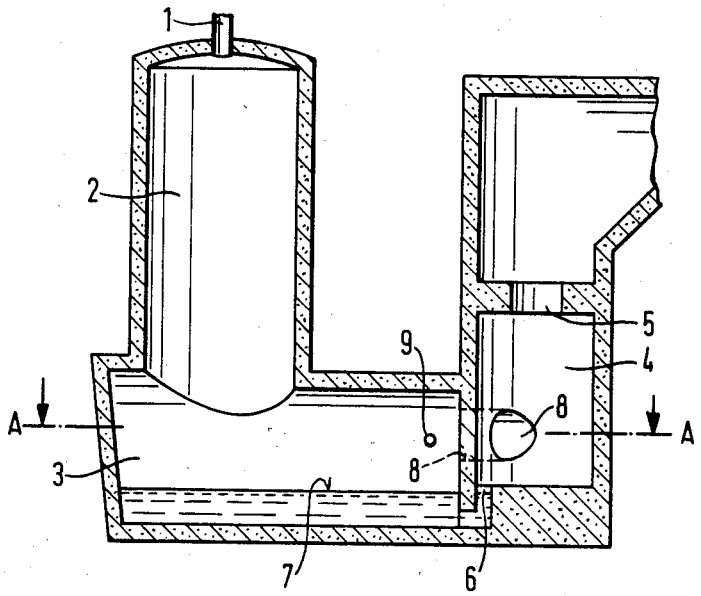
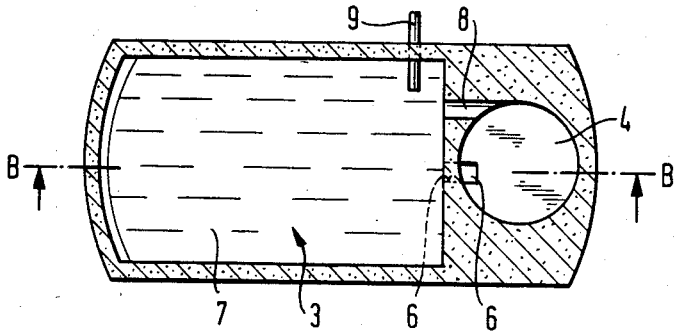
Fig. 2

Fig. 4
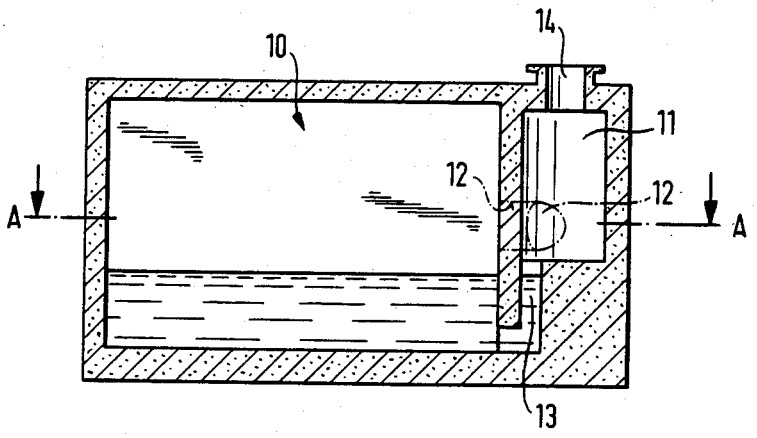
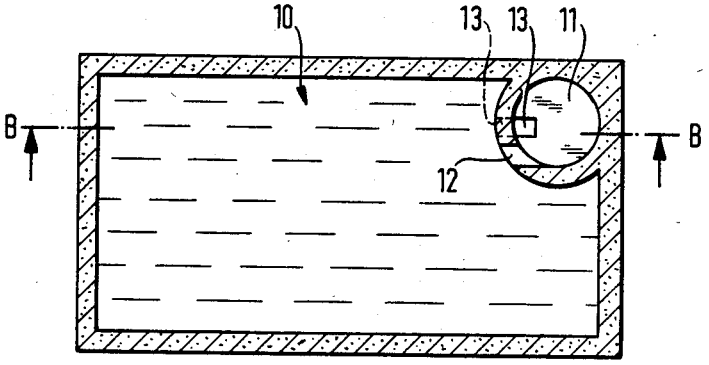
Fig. 5

MEANS FOR SEPARATING SOLID AND MOLTEN PARTICLES FROM THE EXHAUST GASES OF METALLURGICAL FURNACES AND WAY TO RECOVER LEAD FROM SUCH GASES

The present invention concerns a means for separating molten particles, in particular lead droplets, from the exhaust gases of metallurgical furnaces, such as a flash smelting furnace and an electric furnace, and for their returning to the furnace space. In addition, this invention concerns a way to recover lead from the exhaust gases of a metallurgical furnace, such as a flash smelting furnace treating lead concentrates and an electric furnace used to purify the slag from such a furnace.

It is a typical feature in the operation of many pyrometallurgical furnaces that part of the material under treatment escapes in the form of dust along with the furnace gases.

The dust may be divided into two main groups: so-called "mechanical dusts" which are entrained with the gases owing to their fine divided state, in molten or solid form, and "dusts" which owing to their high vapour pressure escape from the furnace in gaseous form. The dusts of the first group are usually slag components, metals that are being produced, or their compounds. In the latter group are often encountered the detrimental impurities, such as arsenic, bismuth, antimony, lead and zinc. The dusts escaping in gaseous form condense first to small molten droplets, and then to finely divided dust, as the temperature falls after the furnace below the melting point.

It is usual practice that the dusts escaping with the exhaust gas are returned once more together with the feed into the furnace. In addition to the costs arising from such returning of the dust, great difficulties are caused by the dust to the operation of the waste heat boiler and to the keeping clean of the boiler. It is also highly detrimental that volatile impurities are enriched in the dust circulation, thus lowering the system's impurity tolerance.

In the art is known (DE-OS No. 2 946 032) a process wherein the exhaust gases carrying lead and zinc which come from the lead processing in a shaft furnace are treated in a separate condensing apparatus. In the condensing apparatus, the gas passes through several condensing units containing molten lead. The direction of the gases is hereafter changed through about 90°, and at the same time the gas impinges either on projections on the walls of the apparatus or on separate deflecting baffles. These serve the purpose of setting the gas in vortex motion so that any molten droplets still present therein will fall into the molten lead underneath. By this procedure condensation of the lead vapour in the gas is achieved, and partly also of the zinc, but the greater part of the zinc remains in the gas phase and escapes from the apparatus.

The object of the present invention is therefore to provide a means for separating molten particles, for instance lead or slag droplets, from the exhaust gases of metallurgical furnaces and for their returning to the furnace space, said means being exceedingly simple and inexpensive and enabling the molten particles that have separated from the exhaust gases to be returned into the furnace space in liquid form merely with the aid of the heat content of the exhaust gases. It is a further object of the present invention to teach a way in which to recover lead from the exhaust gases of a metallurgical furnace, such as a flash smelting furnace or an electric furnace, in such manner that the largest possible part of both the gaseous and condensed lead in the exhaust gases can be separated from the exhaust gases and returned to the furnace while at the same time the more volatile substances contained in the exhaust gases, for instance zinc, remain in the gas phase and escape together with the gases.

The operating temperature of the means in question must be higher than the solidification temperature of the molten droplets in the gas. Since the temperature of metallurgical smelting furnaces is often little above the melting point of the materials that are being treated, the means must be of such construction that the minimum part of the heat contents carried by the melts collected from the gases will be dissipated in the form of heat losses, and that the melts remain in liquid state.

When using a cyclone for separation of the dust present in the gas, it is common practice to place this cyclone outside the furnace. In that case the temperature of the gas in the cyclone has to be such that, with the exception of certain low-melting metals, the dust is in solid state. Taking high-melting slag and metal melts from the outside of the furnace, from the cyclone, back into the furnace is immensely difficult and requires not only gas-tight channels but also efficient heating means.

As taught by the invention, a cyclone has been provided within the furnace or in its immediate vicinity, this cyclone being substantially so placed that the cyclone and the passage thereto attached to the purpose of taking the recovered melt back into the furnace are held by the temperature of the furnace at a high enough temperature, and said cyclone comprising a substantially vertical sylindrical chamber, a passage tangentially entering the chamber to the purpose of leading the exhaust gases into the chamber, an exit aperture in the top part of the chamber for outlet the gases, and a tap aperture in the lower part of the chamber for returning to the furnace the molten material that has separated from the gas. Since the cyclone of the invention has been disposed to be within the furnace space proper or immediately adjacent thereto, the heat losses to ambience from the exhaust gases and from the melt that is being returned into the furnace will be minimized, the melt cyclone can be placed at an elevation higher than the bottom of the furnace space, and hereby the melt separated from the exhaust gases will by itself flow back into the furnace.

With a view to achieveing the most complete condensation of the lead contained in the exhaust gases, a cooling member may be placed before the tangential passage leading to the cyclone, to the purpose of cooling the exhaust gases before they are led into the cyclone.

The molten dust cyclone according to the invention can be disposed in the lower part of the uptake shaft of a flash smelting furnace or in an electric furnace.

When smelting lead concentrates in a flash smelting furnace metallic lead bullion and slag are formed as a product, and the slag contains also zinc in oxydized form in addition with lead. In the process the slag mentioned can be reduced e.g. in an electric furnace in order to recover this lead.

Depending on temperature and degree of reduction, a larger or smaller part of the zinc present in the slag will be reduced to metal and will owing to its high vapour pressure end up in the gas phase of the furnace, into which part of the reduced lead has also evaporated.

In the procedure of the invention, the temperature and oxygen partial pressure of the gas escaping from the furnace are so controlled that the lead in the gas largely condenses to metal fog particles, while the zinc still remains in gaseous state. The lead fog particles are hereafter removed from the furnace gas, as taught by the invention, in a molten dust cyclone, whereas the zinc and such gaseous lead as is still left in the gas pass through the cyclone and they may be later removed from the gas in known ways, e.g. after burning and cooling of the gas by means of bag filters.

The invention is described below in closer detail with reference to the attached drawings, wherein:

FIG. 1 presents the elevational view of a flash furnace apparatus intended to be used in connection with the procedure of the invention, sectioned along line B—B in FIG. 2, FIG. 2 is the section along line A—A in FIG. 1, in FIG. 3 are shown the zinc and lead contents in the gas, plotted over temperature and oxygen pressure, FIG. 4 is the elevational view, sectioned along the line B—B in FIG. 5, of the electric furnace in which the molten dust cyclone has been placed, and FIG. 5 is the section along line A—A in FIG. 4.

From the roof of a flash smelting furnace, or suspension smelting furnace, the concentrate and oxygen or oxygen-enriched air are supplied through the concentrate burner 1 in suspension form into the reaction shaft, or the suspension smelting zone 2. When the direction of the suspension in the flash smelting furnace is turned through 90°, the main part of the melt/solid material in the suspension separates from the gases and settles on the bottom of the settler 3. The sulphur dioxide-containing gas separated in the settler 3 from the suspension contains mechanical dust and melt droplets (for instance, lead compounds).

The uptake shaft, or ascending flow zone, 4 is actually constituted by the molten dust separator or hot cyclone, from which the cleaned gases depart through the aperture 5. The gas is set in tangential motion, and hereby the melt droplets contained in the gas are flung on the walls of the cyclone and will run down into the settler through the passage 6. The passage 6 has been so disposed that the melt droplets flowing downwards meet no gases, in that the passage 6 ends under the surface 7 of the melt. The tangential entrance aperture 8 by which the gases enter the cyclone has been so dimensioned that the velocity of the gases is optimum in view of the recovery of these melt drops. In order that it might be possible to separate with the aid of the cyclone a substantial part of the compounds of lead present in the gas phase, the gases may be cooled before the cyclone at the point 9, with the aid of a cooling agent, for instance water.

In FIG. 3 the contents of gaseous lead and zinc are shown as a function of temperature and oxygen pressure, thermodynamically calculated with ZnO activity 1. Likewise, FIG. 3 shows the boundary of stability of metallic iron with FeO activity 1.

In slag cleaning of the lead process in an electric furnace, the oxygen pressure is regulated to be as low as possible, however so that no metallic iron is formed. The largest possible proportion of the metallic lead in the gas can be made to condense to lead fog particles by adjusting the oxygen pressure to be close to the stability graph of iron in FIG. 3, on its side with higher oxygen pressure in the range where the oxygen partial pressure is about $10^{-16}$ to $10^{-10}$ and by adjusting the temperature to be at its minimum properly 1250–1450 K considering the zinc content of the gas. When the gas is led from the electric furnace through the cyclone of the invention, the lead fog particles will separate from the gas and return to the reducing furnace.

If for instance in a lead slag reducing furnace the oxygen pressure and temperature of the gas are regulated to be at the point (1) marked in the diagram 3, the exhaust gas may contain zinc about 13.1 g per mole and lead no more than about 0.57 g per mole, that is, the mass proportion of zinc and lead in the gas escaping from the furnace is about 23:1.

In FIG. 4 the use of the molten dust cyclone in conjunction with an electric furnace is shown. The electric furnace has been indicated with the reference numeral 10 and the cyclone, with 11. The gases escaping from the electric furnace 10 are led through the tangential entry aperture 12 into the cyclone 11. The melt droplets separating from the gas flow down into the melt, through the passage 13. The gases which have been cleaned of molten droplets leave the cyclone through the aperture 14.

By providing a metallurgical furnace with a molten dust cyclone as taught by the invention, it is possible to remove from the gas the major part of the "mechanical" flue dusts. In such case mainly impurities in gaseous form will escape from the furnace together with the gas. It is no longer necessary to return the dusts to the furnace, and the impurity tolerance of the process increases.

A major problem in the smelting of lead concentrates has heretofore been the large dust quantities, which are due to the high vapour pressures of lead compounds, above all of the sulphide and oxide. In the worst case, several ten percent of the lead that is introduced in the process may end up in the dust.

At high oxygen pressures, the lead is present in the exhaust gas from the furnace in the form of oxide mainly. At normal smelting temperatures, lead oxide has a high vapour pressure, for instance over 0.1 bar at 1300° C. The pressure falls however rapidly with decreasing temperature. The pressure is thus no more than about 0.01 bar at 1100° C. If care is taken that the temperature of the exhaust gas is reasonably high, it will be possible to separate in the molten dust cyclone a large proportion of the lead in the gas. Since the vapour pressure of metallic lead is even lower than that of the oxide, the dust quantity may be further reduced by regulating the oxygen pressure of the gas to be in the range of metallic lead according to the Belgian patent 888.410.

I claim:

1. The combination of a metallurgical furnace and a cyclone for separating solid and molten particles from the furnace exhaust gases and returning such particles to a furnace space of said metallurgical furnace, comprising a cyclone disposed at least partly in the metallurgical furnace, said furnace comprising a substantially vertical chamber, a passage leading from the furnace space tangentially to said chamber for conducting the exhaust gases into the chamber, an exit aperture in the upper part of said chamber, and a draining aperture in the lower part of the chamber for returning melt that has been separated from the exhaust gases back to the furnace space.

2. Means according to claim 1, wherein the cyclone is positioned at higher elevation than the bottom of the furnace space.

3. Means according to claim 1 and including means for introducing a coolant into the furnace to cool the exhaust gases before they are conducted into the cyclone, said coolant introducing means being disposed in the furnace space immediately before the tangential passage leading to the cyclone.

4. Means according to claim 1, 2 or 3, wherein the cyclone is disposed in the lower part of the uptake shaft of a flash smelting furnace.

5. Means according to claim 1 or 2, wherein the cyclone is disposed at least partly within an electric furnace.

* * * * *